US006232854B1

(12) United States Patent
Mikami et al.

(10) Patent No.: US 6,232,854 B1
(45) Date of Patent: May 15, 2001

(54) DIELECTRIC RESONATOR DEVICE, DIELECTRIC FILTER, OSCILLATOR, SHARING DEVICE, AND ELECTRONIC APPARATUS

(75) Inventors: Shigeyuki Mikami, Nagaokakyo; Toshiro Hiratsuka, Kusatsu; Tomiya Sonoda, Muko; Yutaka Ida, Otsu; Kiyoshi Kanagawa, Nagaokakyo, all of (JP)

(73) Assignee: Murata Manufacturing Co., Ltd. (JP)

( * ) Notice: Subject to any disclaimer, the term of this patent is extended or adjusted under 35 U.S.C. 154(b) by 0 days.

(21) Appl. No.: 09/299,189

(22) Filed: Apr. 23, 1999

(30) Foreign Application Priority Data

Apr. 23, 1998 (JP) ..... 10-113297

(51) Int. Cl.[7] ..... H01P 7/10; H01P 1/20; H01P 5/12

(52) U.S. Cl. ..... 333/219.1; 333/204; 333/134

(58) Field of Search ..... 333/202, 204, 333/219.1, 134, 135

(56) References Cited

U.S. PATENT DOCUMENTS 5,786,740 * 7/1998 Ishikawa et al. ..... 333/219.1
6,016,090 * 1/2000 Iio et al. ..... 333/202
6,052,087 * 4/2000 Ishikawa et al. ..... 333/202

FOREIGN PATENT DOCUMENTS 0734088 9/1996 (EP) .
0764996 3/1997 (EP) .
7142912 6/1995 (JP) .

OTHER PUBLICATIONS

UK Search Report dated Oct. 6, 1999.
UK Search Report dated Feb. 4, 2000.
Patent Abstracts of Japan, JP 07142912A.
German Office Action dated Sep. 12, 2000 & English language translation.

* cited by examiner

*Primary Examiner*—Robert Pascal
*Assistant Examiner*—Patricia T. Nguyen
(74) *Attorney, Agent, or Firm*—Ostrolenk, Faber, Gerb & Soffen, LLP

(57) ABSTRACT

In a dielectric resonator device, electrodes having electrode non-formation sections opposite to each other and having substantially the same shape and size are formed on the opposite main faces of a dielectric plate. The portion of the dielectric plate sandwiched between the electrode non-formation sections opposite to each other is used as a dielectric resonator section. Further, the characteristics of the dielectric resonator device are adjusted by attaching dielectric chips inside of the dielectric resonator section or between adjacent dielectric resonator sections.

18 Claims, 16 Drawing Sheets

DIELECTRIC RESONATOR DEVICE, DIELECTRIC FILTER, OSCILLATOR, SHARING DEVICE, AND ELECTRONIC APPARATUS

BACKGROUND OF THE INVENTION

1. Field of the Invention

The present invention relates to a dielectric resonator such as a dielectric filter for use in the microwave band or millimeter wave band, an oscillator, a sharing device, and a communication device each including the dielectric resonator.

2. Description of the Related Art

In order to realize advanced mobile communication services and multi-media communication services, it is necessary to transmit a large quantity of information at an ultra high speed. For this purpose, the millimeter wave band having a wide band width is suitable. As new uses utilizing effectively the characteristics of the millimeter wave band, in addition to the uses of communication, a motorcar radar for preventing collisions is an example. It is much expected that the millimeter wave radar serves the assurance of safety required particularly when it mists or snows, for which a conventional laser radar utilizing light is ineffective.

If a conventional circuit configuration formed mainly of microstrip lines is used in the millimeter wave band, Q is reduced with the loss increased. Further, as regards a $TE_{01\delta}$ dielectric resonator, used widely conventionally, a great amount of resonant energy is leaked to the outside of the resonator. For this reason, in the case of the resonator and the circuit used in the millimeter wave band and having a small relative size, there is the problem that lines are undesirably coupled to each other, and the design and the reproducibility of the characteristics become difficult.

To solve this problem, the inventors have devised PDIC™ (Planar Dielectric Integrated Circuit), and proposed a millimeter wave band module using this technique.

An example of the planar circuit type dielectric resonator incorporated in the module is disclosed in Japanese Unexamined Patent Publication No. 8-265015.

FIG. 19 shows the configuration of the dielectric resonator device. In FIG. 19, there is shown a dielectric plate 3, and on the opposite main faces of the dielectric plate 3, electrodes are formed with electrode-non-formation sections which are circular, have a predetermined size, and are opposite to each other, and the upper electrode of the dielectric plate 3 is shown at a numeral 1 and the electrode non-formation sections at numerals 4*a* and 4*b*. With this configuration, the section of the dielectric resonator device, sandwiched between the electrode-non-formation sections, is used as the dielectric resonator section.

In a device employing the planar circuit dielectric resonator as shown in FIG. 19, metallic adjusting screws are provided for a shield case 24 in such a manner that the insertion amount of the screws in the shield case can be adjusted. With the adjusting screws, the resonant frequency of the dielectric resonator sections and the coupling factor between the adjacent dielectric resonator sections can be adjusted.

However, in the case of the metallic adjusting screws used, an insertion loss is produced in the adjusting screws with the unloaded Q reduced, when the adjusting screws are near to the resonator sections. For this reason, there is the problem that when the dielectric resonator device is used as a filter, its filter characteristics are deteriorated. Further, there is caused the problem that the outside size of the device is large since the adjusting screws are partially projected to be on the outside of the shield case.

SUMMARY OF THE INVENTION

Accordingly, it is an object of the present invention to provide a dielectric resonator device of which the characteristics can be adjusted without its unloaded Q reduced.

It is another object of the present invention to provide a transmission-reception sharing device and a communication device each including the dielectric resonator device, which are small in size, and have excellent characteristics.

According to the present invention, there is provided a dielectric resonator device which comprises electrodes formed on the opposite main faces of a dielectric plate, the electrodes having at least one pair of electrode non-formation sections opposite to each other and having substantially the same shape and size, in which the section of the dielectric resonator device, sandwiched between the electrode non-formation sections opposite to each other, acts as the dielectric resonator section, wherein a dielectric chip is attached to the dielectric resonator section or between adjacent dielectric resonator sections. The resonant frequency of the resonator section, the coupling factor between the adjacent dielectric resonator sections, the external Q factor, and the spurious characteristic are adjusted by the attachment position, the dielectric constant, the size, and the shape of the dielectric chip.

According to another aspect of the invention, a portion of the dielectric resonator device having a different dielectric constant from the dielectric plate may be provided in the dielectric plate in the dielectric resonator section or in the dielectric plate between the adjacent dielectric resonator sections. Thus, the resonant frequency of the resonator section, the coupling factor between the adjacent dielectric resonator sections, the external Q factor, and the spurious characteristic are adjusted.

A dielectric filter may be formed of a signal input-output means for inputting or outputting a signal, provided in the dielectric resonator section. The resonant frequency of the resonator section, the coupling factor between the adjacent dielectric resonator sections, the external Q factor, and the spurious characteristic are determined by the attachment position, the dielectric constant, the size, and the shape of the dielectric chip. Thus, the dielectric filter having characteristics predetermined as described above may be formed.

Further, an oscillator may be formed of a negative characteristic resistance circuit connected to the coupling line coupled to the dielectric resonator section. As described above, the resonant frequency of the resonator section, the coupling factor between the adjacent dielectric resonator sections, the external Q factor, and the spurious characteristic are determined by the attachment position, the dielectric constant, the size, and the shape of the dielectric chip attached to the dielectric plate, or by the size and shape of a portion of the dielectric plate having a different dielectric constant. Thus, the oscillator having characteristics predetermined as described above may be formed.

According to the present invention, a sharing device may be formed of at least one of the signal input-output means being connected to a plurality of the dielectric resonator sections. For example, a duplexer provided with a transmitting filter and a receiving filter, and a multiplexer provided with at least three filters may be formed. Thus, the sharing device with a lower insertion loss and excellent branching characteristics can be attained.

Further, an electronic apparatus such as a communication device or the like may be formed, including in its high frequency circuit section one of the dielectric resonator device, the dielectric filter, and the sharing device. Thus, the electronic apparatus having the high frequency circuit with low loss and spurious characteristic can be attained.

BRIEF DESCRIPTION OF THE DRAWINGS

FIG. 2B illustrates the change of the resonant frequency with the relative dielectric constant when the attachment position of the dielectric chip is changed;

DESCRIPTION OF THE PREFERRED EMBODIMENT

A first embodiment of the present invention will now be described with reference to FIGS. 1 through 6.

Figure 1A:
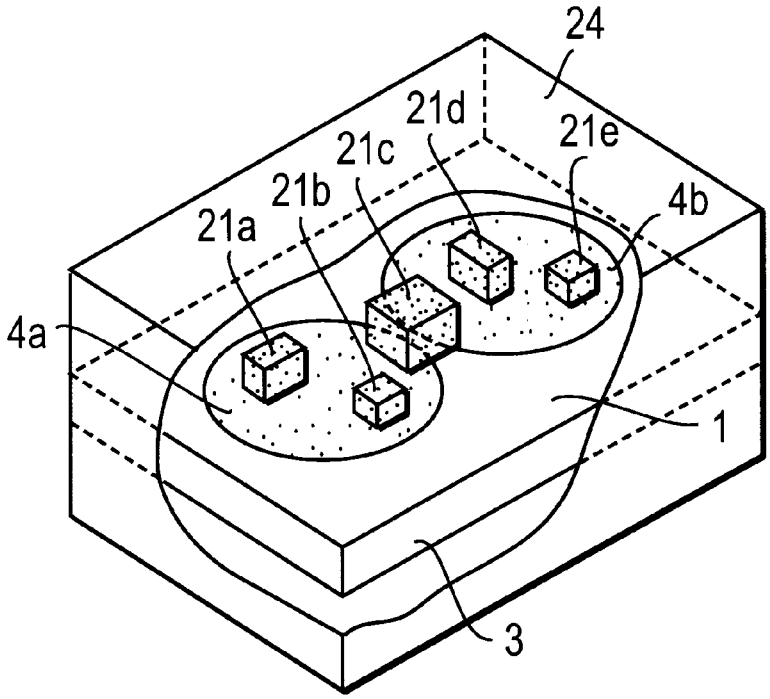
FIGS. 1A and 1B are illustrations of the configuration of a dielectric filter according to a first embodiment of the present invention.
Figure 1B:
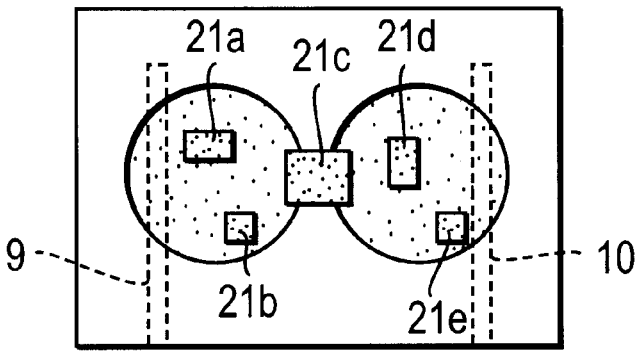

FIG. 1A is a partly broken schematic perspective view of a dielectric filter, and FIG. 1B is a plan view of the dielectric filter in its state that a shield case is removed from the dielectric filter. In FIG. 1A shown is a dielectric plate 3 made of a dielectric ceramic, and on the upper face of the dielectric plate formed is an electrode 1 having electrode non-formation portions 4*a* and 4*b*. On the lower face of the dielectric plate 3 formed are the electrode non-formation sections which are opposite to the electrode non-formation sections 4*a* and 4*b* and have the same shape and size as the sections 4*a* and 4*b*, and thereby, the electrode non-formation sections opposite to each other act as a dielectric resonator section in the TEO10 mode, respectively. The resonant frequencies of these dielectric resonators lie, for example, in the 20 GHz band.

Parallelepiped dielectric chips 21*a*, 21*b*, 21*c*, 21*d*, and 21*e* are shown and fixed by bonding, for example, with an epoxy type adhesive, to the dielectric plate 3 in its predetermined positions.

By providing the dielectric chips on the dielectric plate as described above, the characteristics of the dielectric resonator device are adjusted. First, an example of the adjustment of the resonant frequency will be now described with reference to FIG. 2.

Figure 2A:
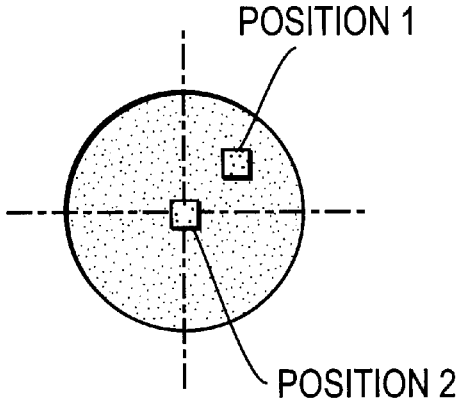
FIG. 2A is an illustration of the attachment position of a dielectric chip to a dielectric resonator section.
Figure 2B:
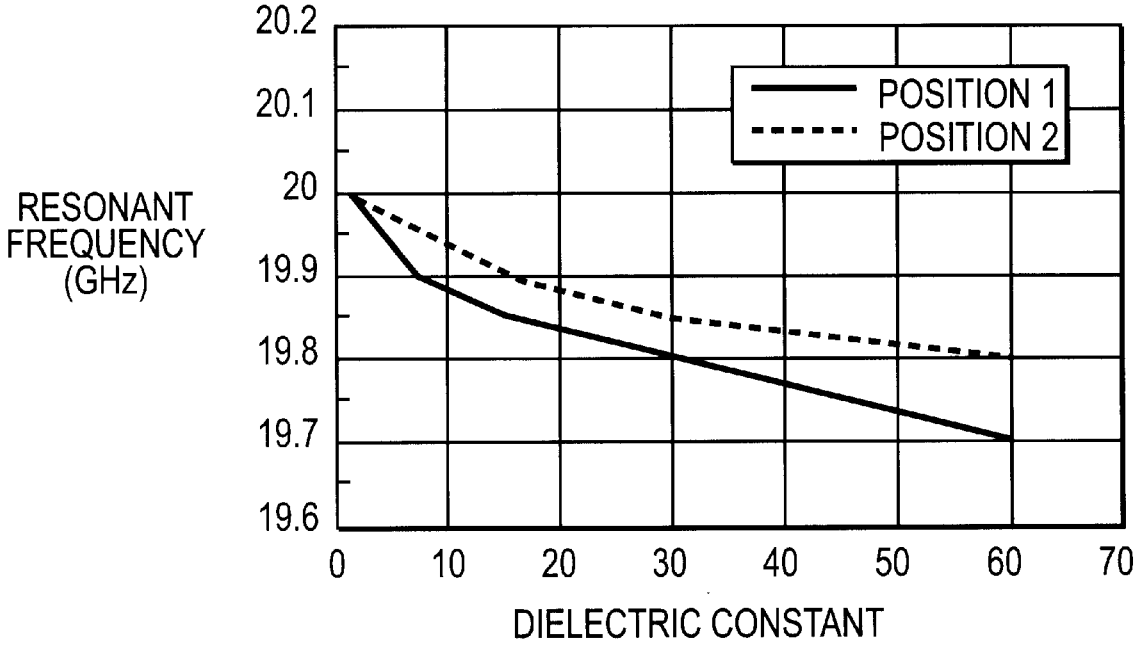
FIG. 2B is a graph showing the relationship of the resonant frequency to the dielectric constant.

FIG. 2A is a plan view illustrating the position of the dielectric chip in the dielectric resonator section (electrode non-formation sections). FIG. 2B illustrates the change of the resonant frequency with the relative dielectric constant when the attachment position of the dielectric chip is changed. In this case, the diameter of the resonator section (the diameter of the electrode non-formation section) is 4.35 mm, the thickness of the dielectric resonator section (the thickness of the dielectric plate) is 1.0 mm, and the relative dielectric constant $\epsilon r$ is 30. The size of the dielectric chip is 1×1 mm square with the thickness of 0.5 mm.

As seen in FIG. 2B, the resonant frequency is decreased with the dielectric chip provided in the electrode non-formation section. It is understood that as the relative dielectric constant of the dielectric chip is higher, the resonant frequency is lower, and moreover, as the attachment position of the dielectric chip is more distant from the center thereof, the effect of reducing the resonant frequency is enhanced. Accordingly, the dielectric chip with the dielectric constant, the size, and the shape, appropriately selected depending on the purposes for which the resonant frequency is adjusted, may be bonded and fixed at a predetermined position. Further, as shown in FIG. 1, at least two dielectric chips may be attached to one dielectric resonator section. For example, by arranging the dielectric chip having a relatively large size near to the circumference of the electrode non-formation section, the resonant frequency may be roughly adjusted, and by arranging the dielectric chip having a relatively small size near to the center of the electrode non-formation section, the resonant frequency may be fine adjusted.

The above-described adjustment may be performed by examining the position in which the dielectric chip is to be bonded while the resonant frequency is measured with a meter, and then bonding the dielectric chip in the position in which predetermined characteristics can be attained.

Figure 3A:
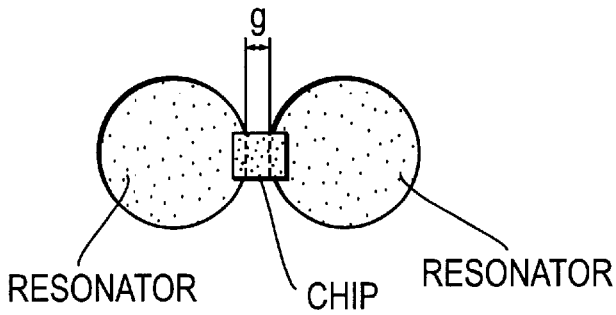
FIG. 3A is an illustration of the size of a dielectric chip provided between adjacent dielectric resonator sections.
Figure 3B:
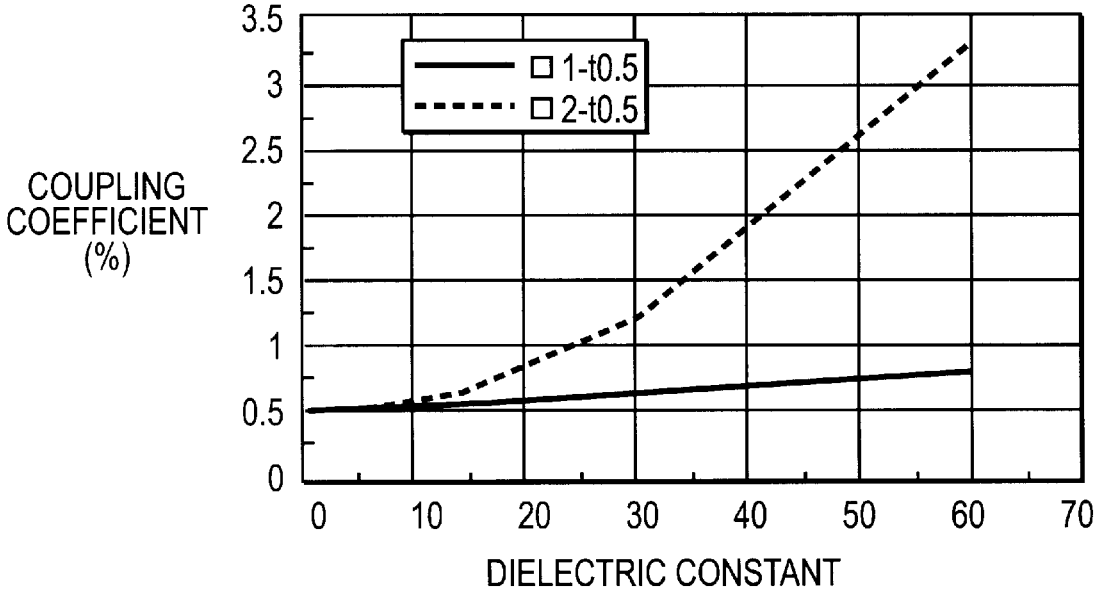
FIG. 3B is a graph showing the relationship of the coupling factor to the dielectric constant.

Hereinafter, it will be described by way of an example and with reference to FIG. 3 that the resonant frequency of each dielectric resonator section is adjusted, and then, the coupling factor between the dielectric resonator sections is adjusted. FIG. 3A shows the position in which the dielectric chip for adjusting the coupling is arranged. FIG. 3B illustrates the change of the coupling factor with the relative dielectric constant when the size of the dielectric chip is changed. In this case, the arrangement of the two resonator sections are the same as described above. The gap between the two dielectric resonator sections is 0.5 mm. In FIG. 3A shown are two types of the dielectric chips with a size of 1×1 mm square and a thickness of 0.5 mm and with a size of 2×2 mm square and a thickness of 0.5 mm.

As seen in FIG. 3B, if the dielectric chip is arranged between the dielectric resonator sections, the inductive coupling between the adjacent dielectric resonator sections is increased, so that the coupling factor is enhanced. In addition, it is understood that even if the relative dielectric constants are equal, as the size of the dielectric chip is larger, the coupling factor is increased. Accordingly, the size and the relative dielectric constant of the dielectric chip may be so selected that a predetermined coupling factor can be attained, or predetermined filter characteristics, determined by the coupling factor, can be attained.

Figure 4:
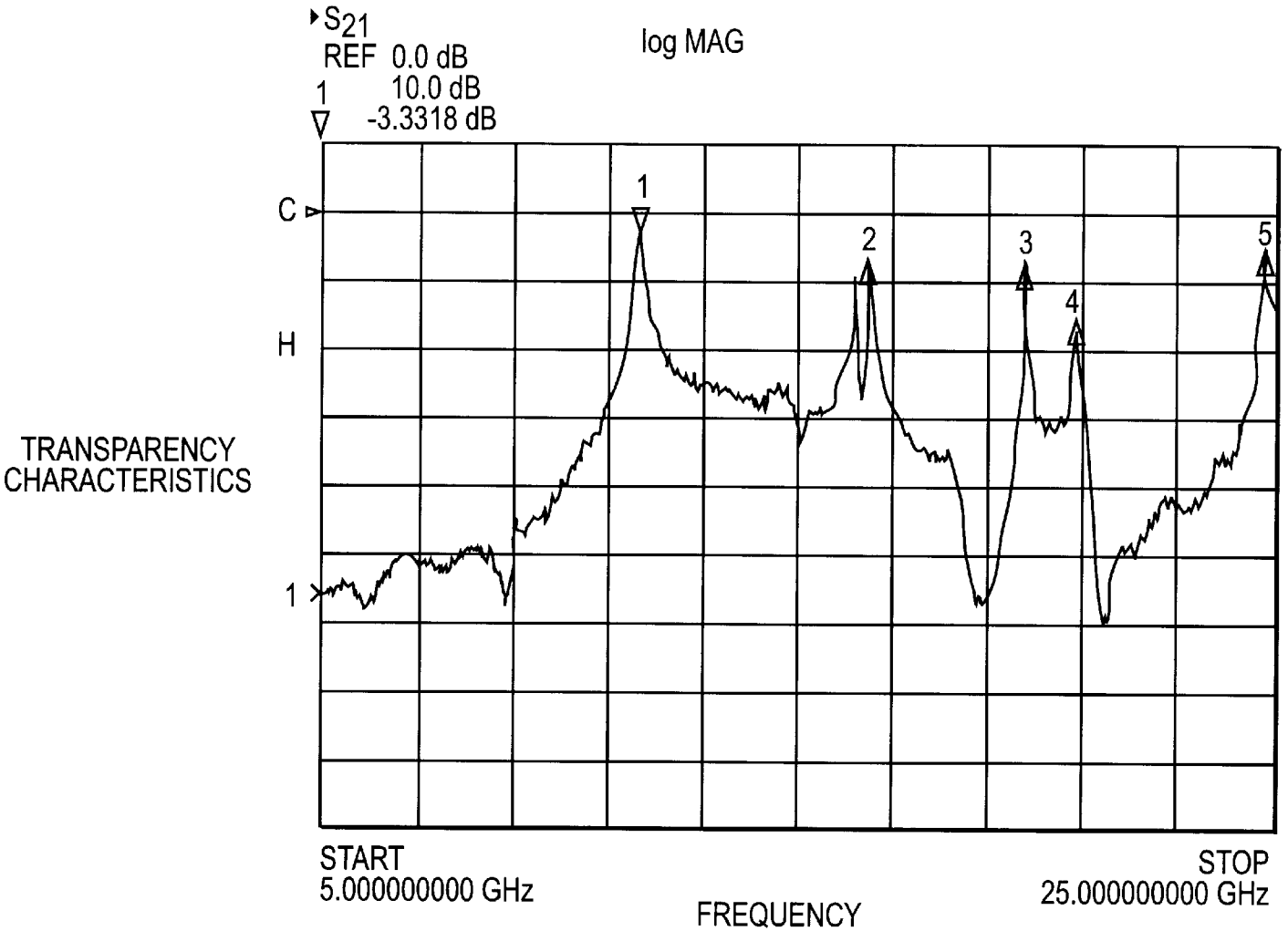
FIG. 4 is a graph showing an example of the transparency characteristic of a dielectric resonator in the basic mode and the spurious mode.

FIG. 4 shows the transparency characteristics of a resonator formed by the above-described dielectric resonator section in the TE010 mode and the spurious mode near to the TE010 mode. In FIG. 4, marks 1, 2, 3, and 4 represent responses in the HE110 mode, the HE210 mode, the TE010 mode, and the HE310 mode, respectively. In this case, the HE210 mode and the HE310 mode are spurious modes appearing near to the TE010 mode. If this dielectric resonator device is used as a dielectric filter, not only the resonant frequency in the TE010 mode but also its differences df (HE210) and df (HE310) to the resonant frequency in the spurious modes appearing near to the TE010 mode are important.

An example of adjustment of the spurious characteristics will be now described with reference to FIGS. 5 and 6.

Figure 5A:
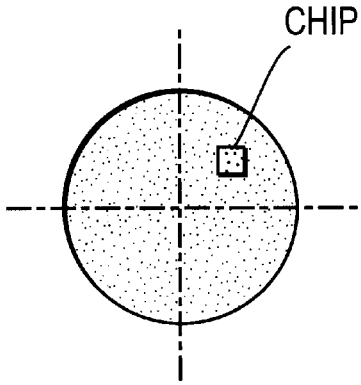
FIG. 5A is an illustration of the attachment position of the dielectric chip to the dielectric resonator section.
Figure 5B:
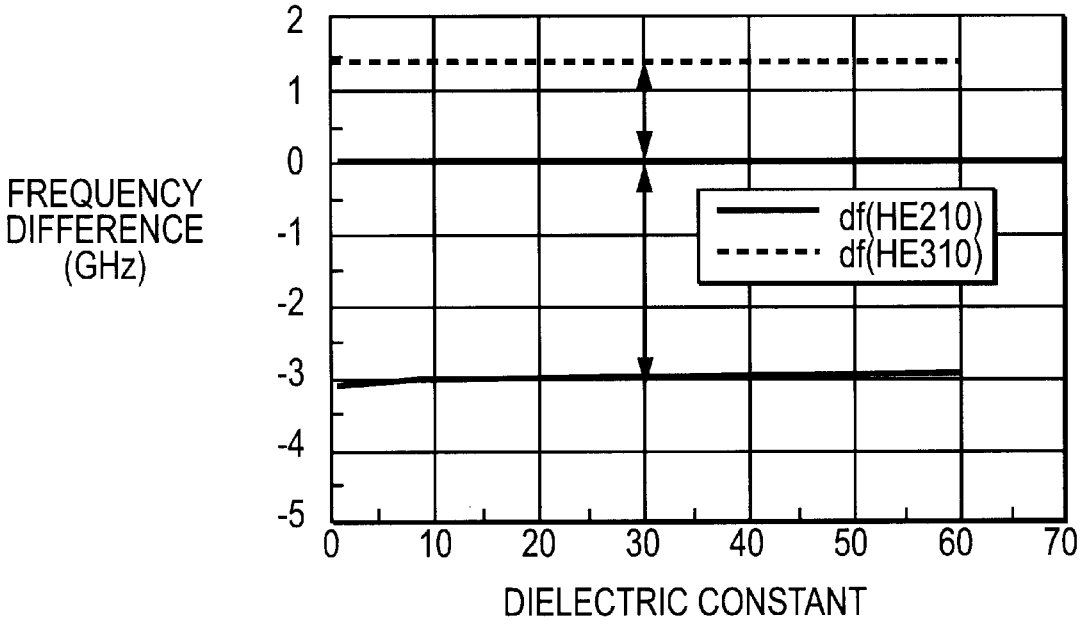
FIG. 5B is a graph showing the relationship of the frequency difference between the basic mode and the spurious mode to the dielectric constant of the dielectric chip.
Figure 6A:
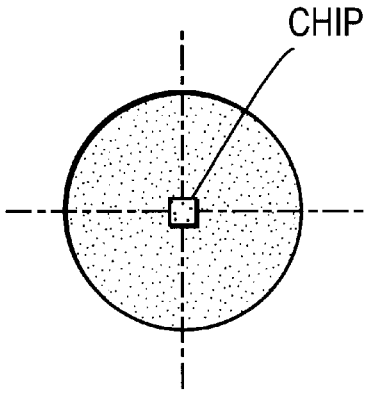
FIG. 6A is an illustration of the attachment position of the dielectric chip to the dielectric resonator section.
Figure 6B:
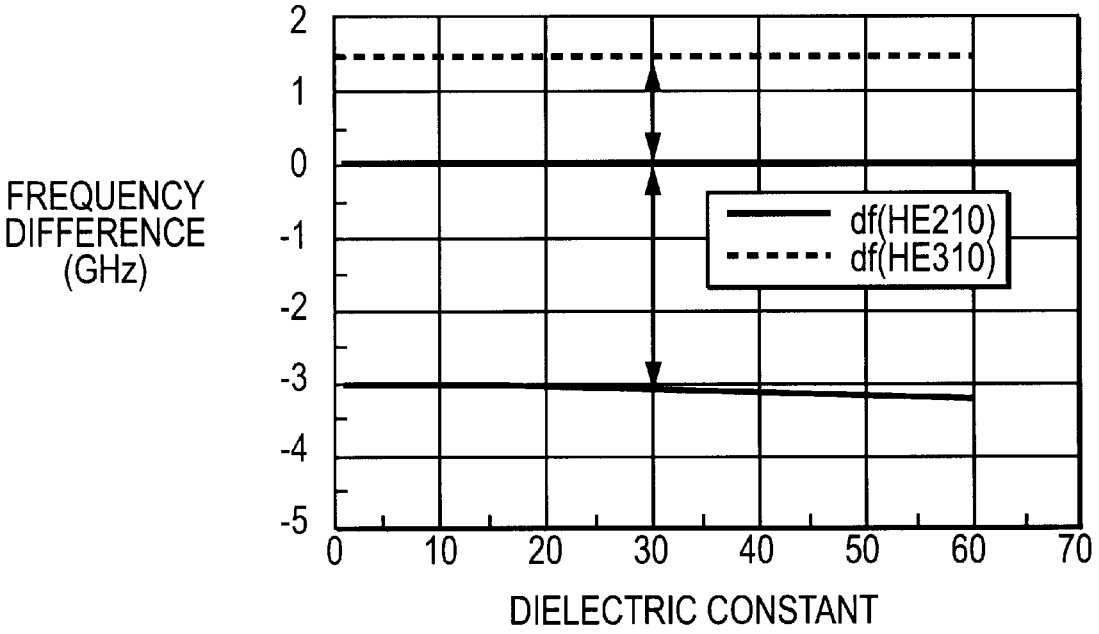
FIG. 6B is a graph showing the relationship of the frequency difference between the basic mode and the spurious mode to the dielectric constant of the dielectric chip.

FIGS. 5A and 6A show the positions of the dielectric chip arranged in the electrode non-formation section, and FIGS. 5B and 6B the frequency differences df (HE210) and df (HE310) when the dielectric chip is arranged in the positions. FIGS. 5A and 5B illustrate an example of that the dielectric chip is arranged in a position some distance from the center of the electrode non-formation section, and FIGS. 6A and 6B an example of that the dielectric chip is arranged in the center of the electrode non-formation section. In this case, the dielectric chip has a size of 1×1 mm square with a thickness of 0.5 mm. The arrangement of the resonator section is the same as shown in FIG. 2. As described above, the differences in resonant frequency of the spurious modes in the HE210 mode, the HE310 mode, and the like to the TE010 mode are changed with the arrangement position of the dielectric chip in the electrode non-formation section and moreover, the relative dielectric constant, as shown in FIG. 5B and FIG. 6B. These resonant frequency differences are varied with the attachment position, the dielectric constant, the size, and the shape of the dielectric chip. Thus, the resonant frequency of the TE010 mode can be set to have a predetermined value, and moreover, the resonant frequency differences of the spurious modes to the TE010 modes can be adjusted.

Then, the arrangement of the dielectric resonator device of a second embodiment will be described with reference to FIGS. 7 through 9.

Figure 7A:
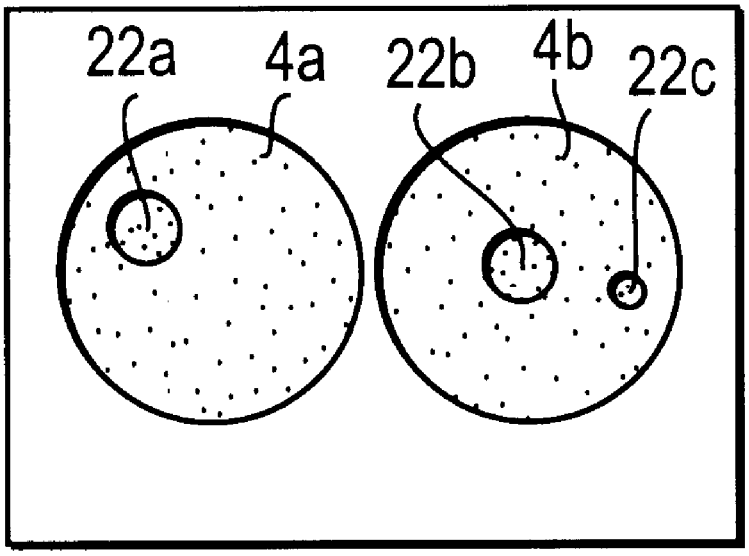
FIGS. 7A and 7B are illustrations of an example of that dielectric pieces are buried in the dielectric resonator sections.
Figure 7B:
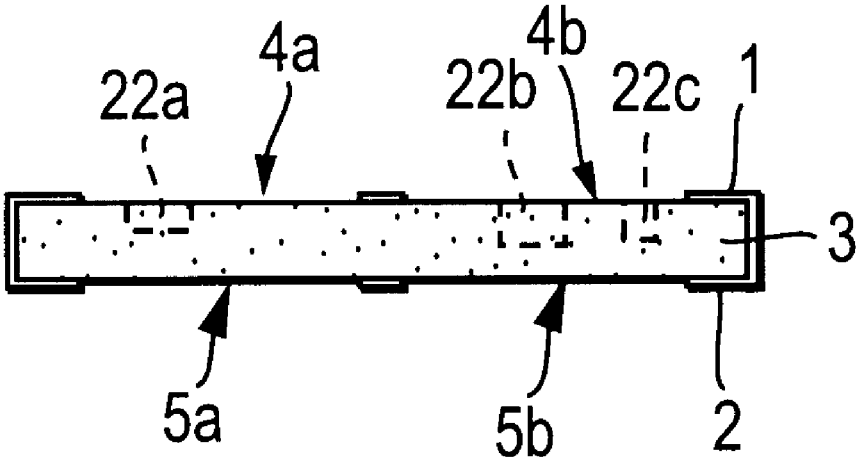

In the first embodiment, given is the example that the dielectric chip is fixed by bonding to the upper face of the dielectric plate. In the second embodiment, a dielectric piece having a different dielectric constant from the dielectric plate 3 is buried in the dielectric plate. FIG. 7A is a plan view of the dielectric plate, and FIG. 7B is a cross-sectional view thereof. In this example, a dielectric piece 22*a* is buried inside of the electrode non-formation section 4*a*, and the dielectric pieces 22*b* and 22*c* inside of the electrode non-formation section 4*b*, respectively.

Figure 8A:
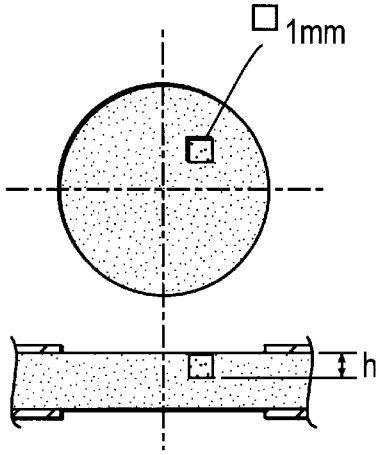
FIG. 8A consists of two illustrations of the position of the buried dielectric piece in the dielectric resonator section.
Figure 8B:
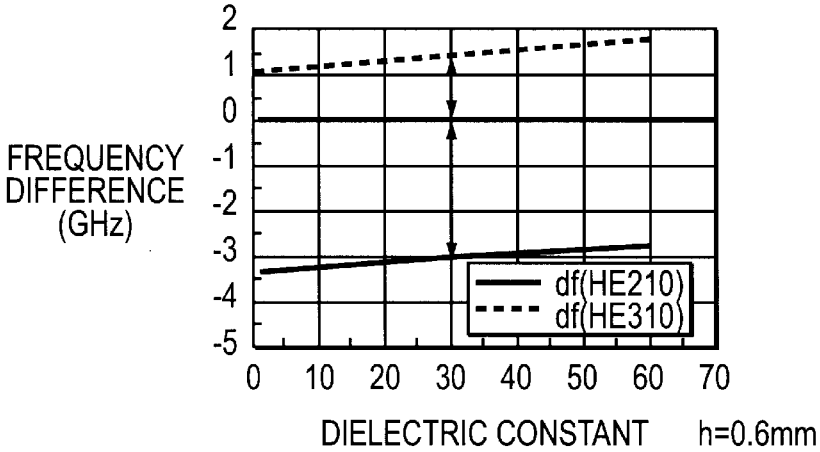
FIGS. 8B and 8C are graphs showing the relationship of the frequency difference between the basic mode and the spurious mode to the dielectric constant of the dielectric piece.
Figure 8C:
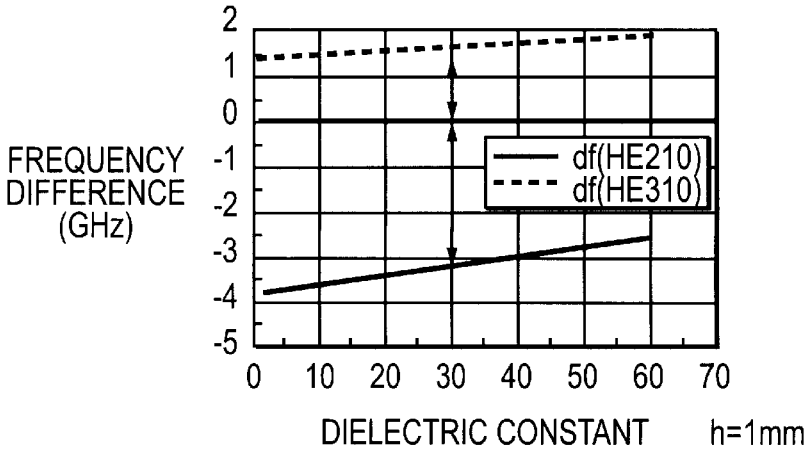
Figure 9A:
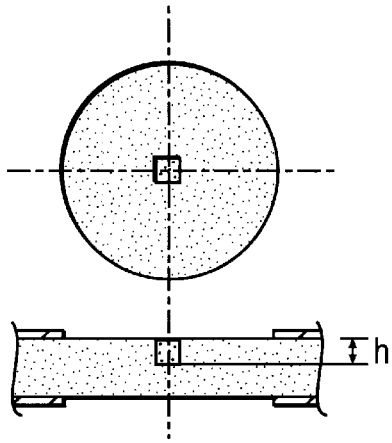
FIG. 9A consists of two illustrations of the position of the dielectric piece buried in the dielectric resonator section.
Figure 9B:
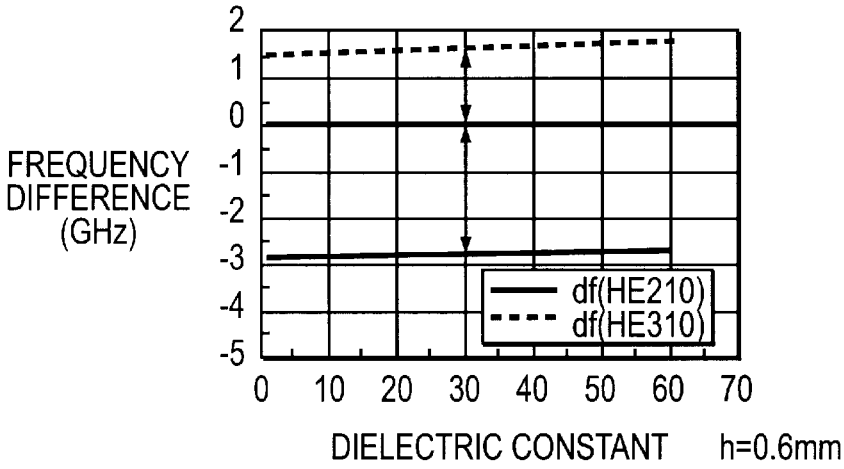
FIGS. 9B and 9C are graphs showing the relationship of the frequency difference between the basic mode and the spurious mode to the dielectric constant of the dielectric piece.
Figure 9C:
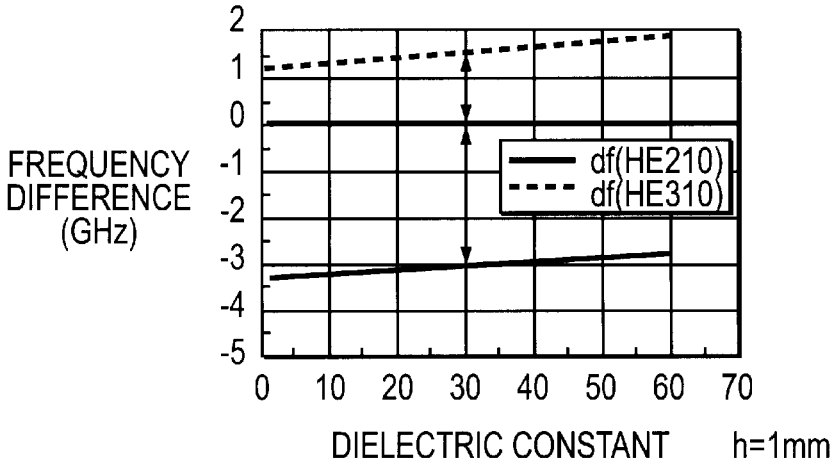

FIG. 8A and FIG. 9A show the positions of the buried dielectric piece, and FIG. 8B and FIG. 9B illustrate the relationship of the differences in frequency between the spurious modes and the basic mode (TE010 mode). In any of the cases, the dielectric piece with a size of 1×1 mm square and a depth h is buried. In FIG. 8A, the dielectric piece is buried in a position some distance from the center of the dielectric resonator section. In FIGS. 8B and 8C, the depths are 0.6 mm and 1 mm, respectively. In FIG. 9A, the dielectric piece is buried in the center of the dielectric resonator section. In FIGS. 9B, and 9(C), the depths h are 0.6 mm and 1 mm, respectively.

As described above, the resonant frequency differences of the neighboring spurious modes to the basic mode can be adjusted with the position in which the dielectric piece is buried, its depth, and its dielectric constant.

Figure 10A:
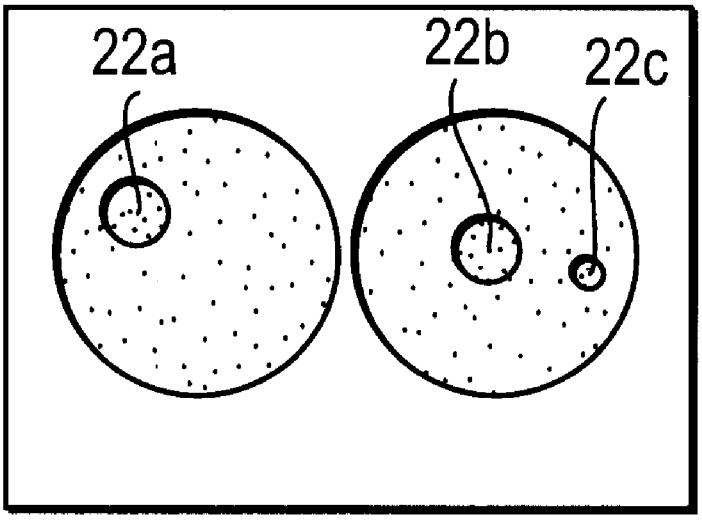
FIGS. 10A and 10B are illustrations of another example that the buried dielectric pieces are in the dielectric resonator sections.
Figure 10B:
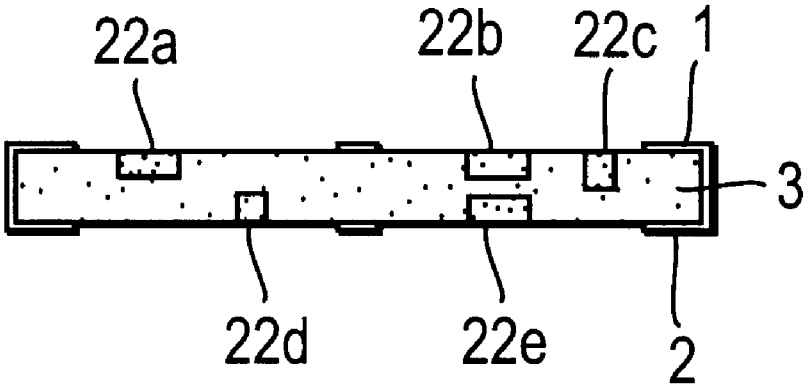
Figure 11A:
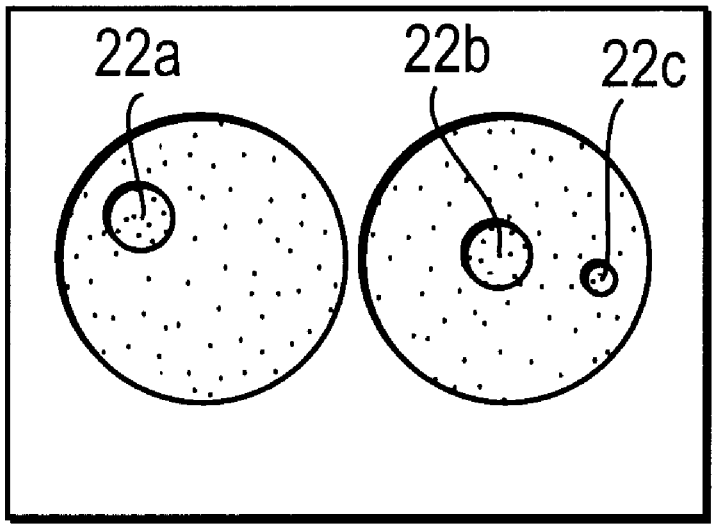
FIGS. 11A and 11B are illustrations of a sill further example of that the buried dielectric pieces are in the dielectric resonator sections.
Figure 11B:
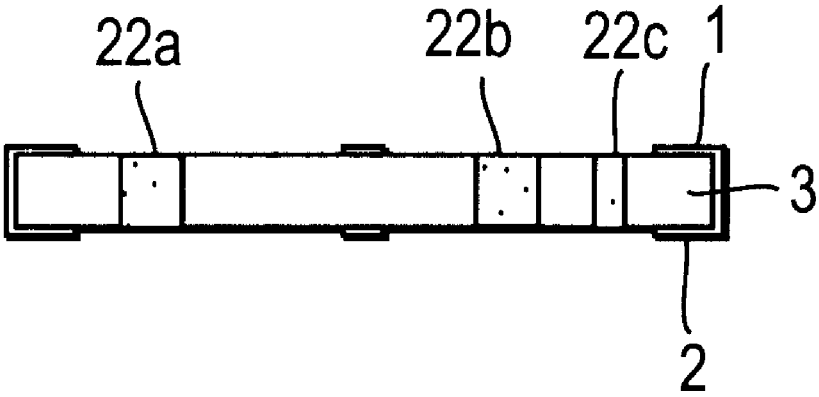

In the example shown in FIG. 7, the dielectric piece having a predetermined depth is buried in the upper face of the dielectric plate. For example, as shown in FIG. 10, the dielectric pieces 22*a*, 22*b*, and 22*c* may be buried in the upper face of the dielectric plate 3, and dielectric pieces 22*d* and 22*e* in the lower face thereof. In addition, as shown in FIG. 11, the dielectric pieces 22*a*, 22*b*, and 22*c* are so disposed that they are elongated through the upper and lower faces thereof. Further, the dielectric pieces may be buried inside of the dielectric plate 3 without the dielectric piece exposed.

In the above-described embodiment, described is an example of that the dielectric pieces having a different dielectric constant from the dielectric plate are buried. However, as the dielectric pieces, air may be employed. That is, a digging portion or a perforation may be formed in the dielectric plate.

Figure 12A:
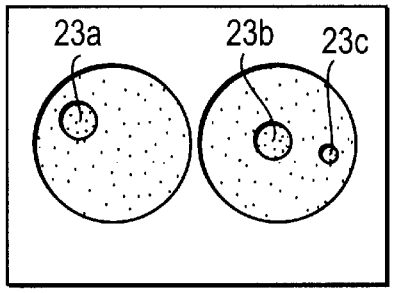
FIGS. 12A and 12B are illustrations of an example that digging portions are formed in the dielectric resonator sections.
Figure 12B:
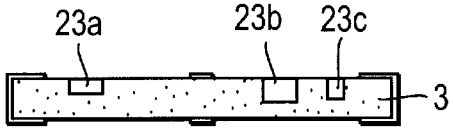
Figure 13A:
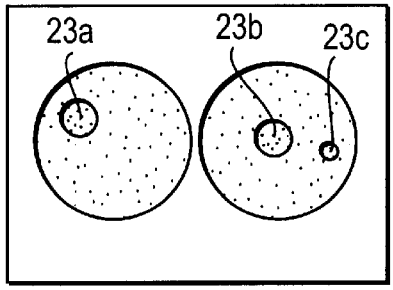
FIGS. 13A and 13B are illustrations of another example of that digging portions are formed in the dielectric resonator sections.
Figure 13B:
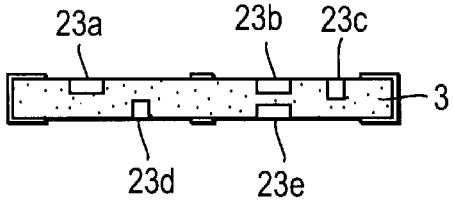
Figure 14A:
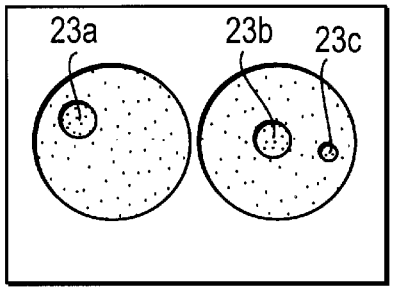
FIGS. 14A and 14B are illustrations of an example of that perforations are formed in the dielectric resonator sections.
Figure 14B:
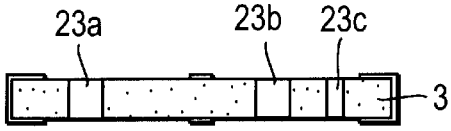

FIG. 12 shows an example of that digging portions 23*a*, 23*b*, and 23*c* are provided in the upper face of the dielectric plate 3. Further, FIG. 13 shows an example of that the digging portions 23*a*, 23*b*, and 23*c* are formed in the upper face of the dielectric plate 3, and digging portion 23*d* and 23*e* in the lower face thereof. Furthermore, FIG. 14 shows an example of that perforations 23*a*, 23*b*, and 23*c* are provided for the dielectric plate 3.

Figure 15A:
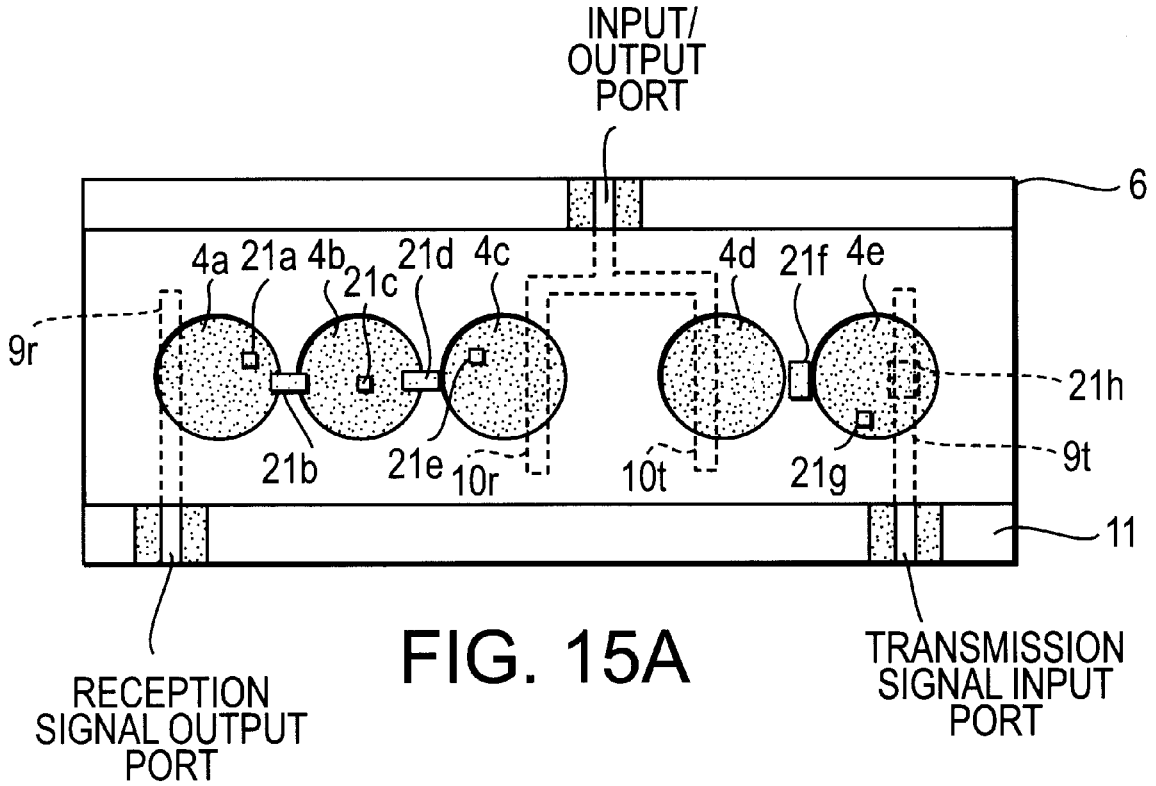
FIGS. 15A and 15B are illustrations of an example of the configuration of a transmitting-receiving sharing device.
Figure 15B:
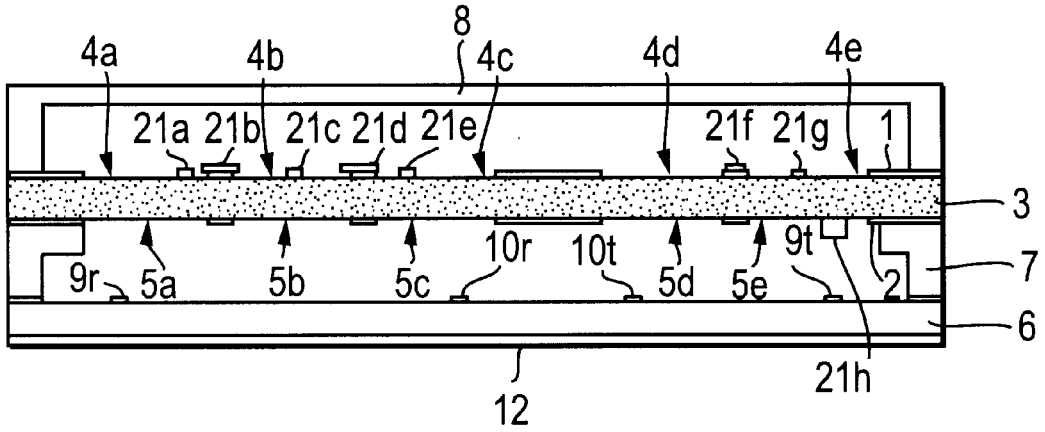

FIGS. 15A and 15B show an example of the configuration of a transmitting-receiving sharing device. FIG. 15A is a plan view showing the state that the upper cover 8 is removed. FIG. 15B is a cross-sectional view of the whole of the transmitting-receiving sharing device. The electrode 1 having five electrode non-formation sections 4*a* through 4*e* are formed in the upper face of the dielectric plate 3, and in the lower face thereof formed is an electrode 2 having electrode non-formation sections 5*a* through 5*e* opposite to the above-described electrode non-formation sections 4*a* through 4*e*, respectively. Thus, dielectric resonator sections in five TE010 modes are formed in the dielectric plate 3.

Dielectric chips 21*a*, 21*c*, 21*e*, and 21*g* are bonded to the above-described dielectric resonator sections at their predetermined positions so that the predetermined resonant frequencies are adjusted. In addition, by bonding dielectric chips 21*b*, 21*d*, and 21*f* between predetermined adjacent dielectric resonator sections thereof, the coupling factor between both the electric resonator sections is adjusted.

The three dielectric resonator sections formed in these electrode non-formation sections 4*a*, 4*b*, 4*c*, 5*a*, 5*b*, and 5*c* are used as a receiving filter composed of three stage resonators. In additions the two dielectric resonator sections formed in the electrode non-formation sections 4*d*, 4*e*, 5*d*, and 5*e* are used as a transmitting filter composed of two stage resonators.

The dielectric plate 3 is attached to the upper side of a base plate 6 through a frame 7. A cover 8 is placed on the upper side of the dielectric plate 3. Microstrip lines 9*r*, 10*r*, 10*t*, and 9*t* are formed as four probes in the upper face of the base plate 6. A ground electrode 12 is formed substantially on the whole of the lower face of the base plate 6.

A dielectric chip 21*h* is bonded to the lower face of the dielectric plate 3 at a position thereof near to the microstrip line 9*t*, and thereby, the coupling factor between the dielectric resonator section formed of the electrode non-formation sections 4*e* and 5*e* and the micronstrip line 9*t* is adjusted to obtain an external Q factor (Qe).

In the above-described case, the ends of the microstrip lines 9*r* and 9*t* are used as a receiving signal output port and a transmitting signal input port, respectively. The ends of the microstrip lines 10*r* and 10*t* are connected with a microstrip line for branching and extended to the outside for use as an input-output port. In this case, the electrical length from the branching point of the microstrip lines 10*r* and 10*t* to the equivalent short circuiting plane of the first stage of the receiving filter is set to have a relationship of odd number times of $\lambda gt/4$ in which $\lambda gt$ represents the wavelength at a transmitting frequency in the microstrip line. Further, the electrical length from the branching point of the microstrip lines 10*r* and 10*t* to the equivalent short circuiting plane of the last stage of the transmitting filter is set to have a relationship of odd number times of $\lambda gt/4$ in which $\lambda gt$ represents the wavelength at a receiving frequency in the microstrip line.

Further, in addition to the method of bonding the dielectric chips, as described previously, by formation of the digging portions in predetermined positions of the dielectric plate by means of a fine cutting tool, the resonant frequencies and the coupling factors may be adjusted.

As described above, since the characteristics are adjusted on the single base plate and inside of the cover 8, the projection into the outside of the screws for adjusting the characteristics is eliminated, and the transmission reception sharing device miniaturized as a whole can be attained.

Figure 16:
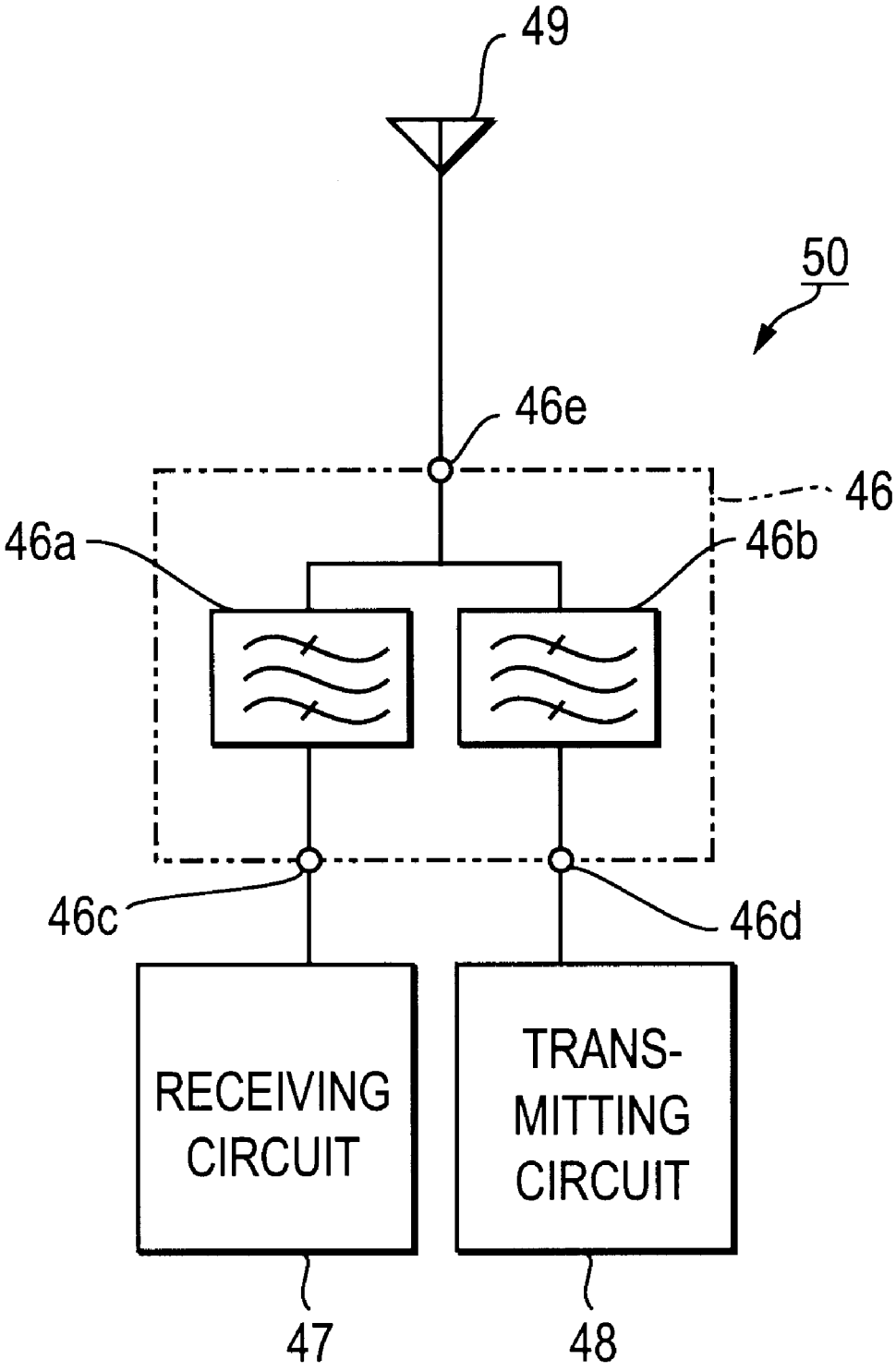
FIG. 16 is a block diagram showing an example of the configuration of a communication device.

FIG. 16 is an illustration of an embodiment of a communication device in which the above-described transmission-reception sharing device is employed as an antenna sharing device. In FIG. 16, shown are the above-described receiving filter 46*a* and the above-described transmitting filter 46*b*, which form the antenna sharing device 46. As shown in FIG. 16, a receiving circuit 47 is connected to a receiving signal output port 46*c* of the antenna sharing device 46, and a transmitting circuit 48 to a transmitting signal input port 46*d*, and moreover, an antenna 49 is connected to an antenna port 46*e*, and thereby, as a whole, a communication device 50 is formed. This communication device corresponds to a high frequency circuit section of a portable telephone or the like.

As described above, by employing the antenna sharing device to which the dielectric filter of the present invention is applied, a compact type communication device including the antenna sharing device which is small in size and has low loss and spurious characteristic. can be formed.

An example of the configuration of an oscillator will be now described with reference to FIGS. 17A and 17B and 18.

Figure 17A:
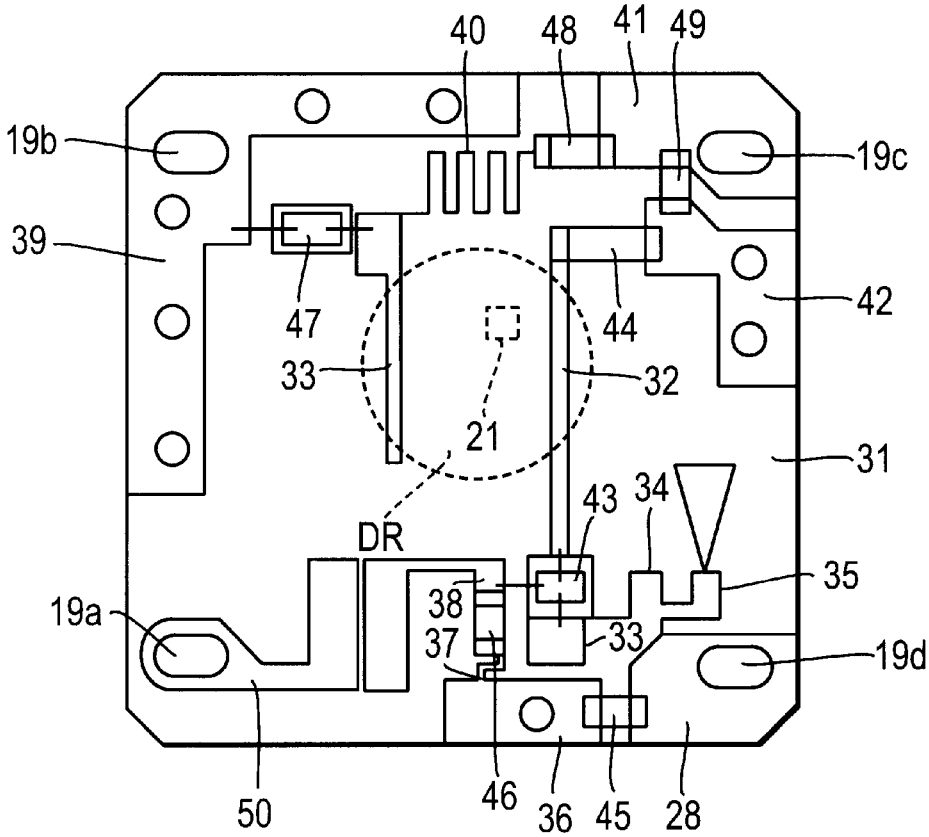
FIGS. 17A and 17B are illustrations of an example of the configuration of an oscillator.
Figure 17B:
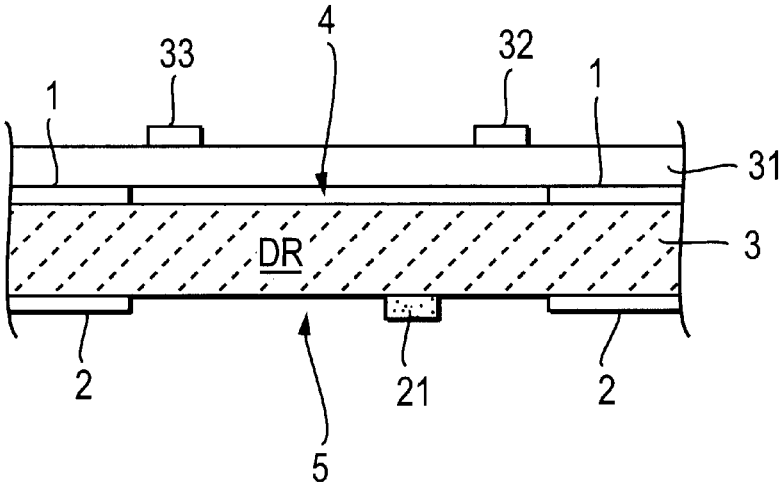

FIGS. 17 are illustrations of the whole structure of an oscillator. FIG. 17A is a plan view of the oscillator, and FIG. 17B is a cross sectional view of the dielectric resonator section. In FIG. 17B, the electrodes 1 and 2 having a pair of the electrode non-formation sections 4 and 5 opposite to each other, are formed on the upper and lower faces of the dielectric plate 3, and a dielectric resonator DR in the TE010 mode as the basic mode is formed in the electrode non-formation sections. The resonant frequency of the dielectric resonator DR is set by attaching the dielectric chip 21 to the dielectric resonator DR section.

In FIGS. 17A and 17B, an insulating circuit board 31 with a relatively low dielectric constant is shown on the upper face of which an electrode pattern such as strip lines 32, 33, and the like are formed. A chip component is mounted at a predetermined position. Further, terminal insertion holes 19*a*, 19*b*, 19*c*, and 19*d* are formed in four positions. FET 43 and a varactor diode 47 are connected to the one-side ends of strip lines 32 and 33, respectively. The other-side end of the varactor diode 47 is connected to an earth electrode 39. An inductor 40 and a resistance film 48 are included between the end of the strip line 32 and an electrode 41 for a control terminal. The end of the strip line 32 is resistance-terminated by providing a resistance film 44 between the end of the strip line 32 and the earth electrode 42. Further, a chip capacitor 49 is included between the earth electrode 42 and the electrode 41 for a control terminal. The source of TET 43 is connected to a line conductor 38 for outputting. A resistance film 46 and an inductor 37 are formed between the source of FET 43 and the earth electrode 36. Further, inductors 34 and 35 are provided between the drain of FET 43 and an electrode 28 for a bias terminal, and a chip capacitor 45 is included between the electrode 28 for a bias terminal and the earth electrode 36.

Figure 18:
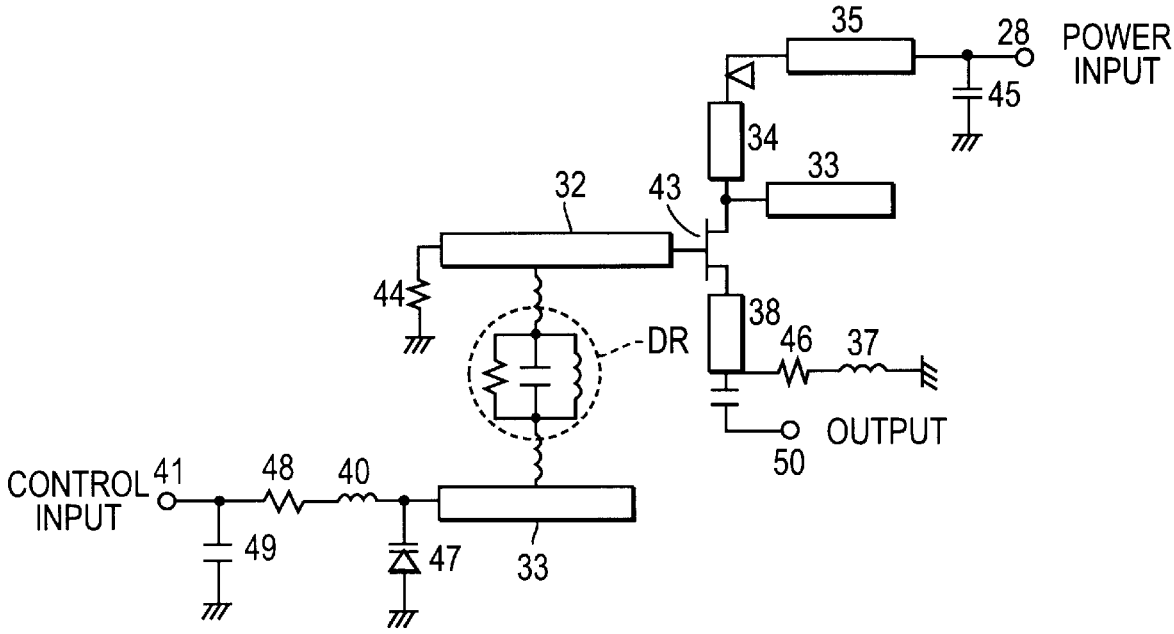
FIG. 18 is an equivalent circuit diagram of the oscillator.
Figure 19:
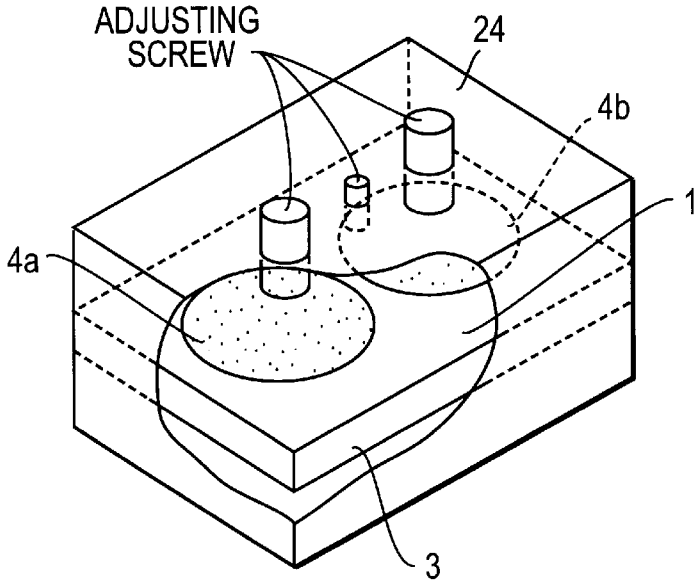
FIG. 19 PRIOR ART
FIG. 19 is an illustration of an example of the configuration of a conventional dielectric filter.

FIG. 18 is an equivalent circuit diagram of the oscillator shown in FIGS. 17A and 17B. In this case, the strip line 32 is a main line coupled to the dielectric resonator DR, and the strip line 33 acts as a sub-line coupled to the dielectric resonator DR. With this circuit configuration, a band-reflection type oscillating circuit is formed. The resonant frequency of the dielectric resonator DR is controlled by changing the capacitance of the varactor diode 47 by means of a control voltage applied to the electrode 41.

The change ratio of the oscillation frequency with the above-described control voltage is determined by the characteristics of the varactor diode. On the other hand, the reference value (for example, center frequency) in the changing range of the oscillation frequency is determined mainly by the resonant frequency of the dielectric resonator DR. Accordingly, the reference value in the changing range of the oscillation frequency is set at a predetermined value by use of the size and the attachment position of the dielectric chip 21 shown in FIG. 17.

As regards the dielectric resonator device of the present invention, its application is not restricted to the dielectric filter, the sharing device, and the oscillator. The dielectric resonator device of the present invention may be applied to different types of high frequency modules including the dielectric resonator.

In addition, the application of the sharing device of the present invention is not restricted to a three-port duplexer such as an antenna sharing device or the like. The sharing device of the present invention may be applied to a multiplexer having at least four ports.

Further, the electronic apparatus of the present invention is not restricted to the communication device including the antenna sharing device, and may be applied to an electronic apparatus which includes the dielectric filter, the sharing device, the oscillator, or the like in its high frequency circuit section.

According to the present invention, the reduction of the non-loading Q factor, caused by the use of the adjusting screw, is eliminated. Thus, when the dielectric filter is configured, the insertion loss can be reduced. Furthermore, since a part of the adjusting screw is prevented from being projected into the outside of the shield case, the apparatus, as a whole, can be easily miniaturized.

The resonant frequency of the resonator section, the coupling factor between the adjacent dielectric resonator sections, the external Q factor, and the spurious characteristics can be adjusted by use of the attachment position of the dielectric chip to the dielectric plate, the formation position of a part having a dielectric constant different from the dielectric plate, the dielectric constant, the size, and the shape of the part. Thus, the adjustment can be carried out in a wide range and with respect to many adjusting items.

What is claimed is:

1. A dielectric resonator device comprising electrodes formed on the opposite main faces of a dielectric plate, said electrodes having at least one pair of non-formation sections opposite to each other which have substantially the same shape and size, in which a portion of the dielectric plate sandwiched between said electrode non-formation sections opposite to each other acts as a dielectric resonator section, wherein a dielectric chip is attached to said dielectric resonator section, a lower surface of said dielectric chip is attached to said dielectric plate entirely within said non-formation section, and said lower surface has an area smaller than the area of said non-formation section.

2. A dielectric resonator device comprising electrodes formed on the opposite main faces of a dielectric plate, said electrodes having at least one pair of electrode non-formation sections opposite to each other which have substantially the same shape and size, in which a portion of the dielectric plate sandwiched between said electrode non-formation sections opposite to each other acts as a dielectric resonator section, wherein a part of said dielectric plate having a different dielectric constant from the rest of said dielectric plate is provided inside of the dielectric plate entirely within said dielectric resonator section, and has an area smaller than the area of said non-formation section.

3. A dielectric resonator device according to claim 1, wherein said dielectric resonator section defines a TE010 mode resonator.

4. A dielectric resonator device according to claim 3, wherein the dielectric constant of the chip is higher than that of the dielectric plate.

5. A dielectric resonator device according to claim 3, wherein the dielectric chip is disposed away from the center of the electrode non-formation section.

6. A dielectric resonator device according to claim 3, wherein at least two dielectric chips are attached to said dielectric resonator section.

7. A dielectric resonator device according to claim 6, wherein said at least two chips have different sizes and the smaller one is arranged nearer to the center of the electrode non-formation section while the larger one is arranged nearer to the circumference of the electrode non-formation section.

8. A dielectric resonator device comprising electrodes formed on the opposite main faces of a dielectric plate, said electrodes having at least two pairs of non-formation sections opposite to each other and having substantially the same shape and size, in which respective portions of the dielectric plate sandwiched between said pairs of electrode non-formation sections opposite to each other act as electromagnetically coupled adjacent dielectric resonator sections, wherein a dielectric chip is attached to said dielectric plate between the adjacent dielectric resonator sections.

9. A dielectric resonator device comprising electrodes formed on the opposite main faces of a dielectric plate, said electrodes having at least two pairs of electrode non-formation sections opposite to each other and having substantially the same shape and size, in which respective portions of the dielectric plate sandwiched between said pairs of electrode non-formation sections opposite to each other act as electromagnetically coupled adjacent dielectric resonator sections, wherein a part of said dielectric plate having a different dielectric constant from the rest of said dielectric plate is provided inside of the dielectric plate between the adjacent dielectric resonator sections.

10. A dielectric duplexer comprising first and second dielectric resonator devices according to one of claims 1, 2, 8 and 9, each device having first and second input-output connectors, each input-output connector being coupled to a dielectric resonator section, said first connector of said first device serving as a transmitter input terminal, said second connector of said second device serving as a receiver output terminal, and said second connector of said first device and said first connector of said second device being connected in common to an antenna terminal.

11. An electronic apparatus comprising the duplexer of claim 10, further comprising a transmitter connected to said transmitter input terminal and a receiver connected to said receiver output terminal.

12. A dielectric filter including a signal input-output connector for inputting or outputting a signal, said input-output connector being coupled to the dielectric resonator section according to one of claims 1, 2, 8 and 9.

13. An oscillator including a coupling line coupled to the dielectric resonator section according to one of claims 1, 2, 8 and 9 and a negative characteristic circuit connected to said coupling line.

14. A sharing device including plural signal input-output connectors and dielectric resonator sections according to claim 12, at least one of said signal input-output connectors being coupled to a plurality of said dielectric resonator sections.

15. An electronic apparatus including:

a high frequency circuit section including the dielectric resonator device according to one of claims 1, 2, 8 and 9;

a dielectric filter, including a plurality of signal input-output connectors for inputting or outputting a signal, coupled to said dielectric resonator section;

an oscillator including a coupling line coupled to said dielectric resonator section and a negative characteristic circuit connected to said coupling line; and a sharing device including said plurality of signal input-output connectors, at least one of said signal input-output connectors being coupled to a plurality of said dielectric resonator sections.

16. An electronic apparatus comprising the filter of claim 12, further comprising a high-frequency circuit including at least one of a transmitting circuit and a receiving circuit connected to said input-output connector.

17. An electronic apparatus comprising the oscillator of claim 13, further comprising a high-frequency circuit including at least one of a transmitting circuit and a receiving circuit connected thereto.

18. An electronic apparatus comprising the dielectric resonator device of any one of claims 1, 2, 8 and 9, further comprising a high-frequency circuit including at least one of a transmitting circuit and a receiving circuit connected thereto.

* * * * *